US005849140A

United States Patent [19]

Bilnoski, Jr.

[11] Patent Number: 5,849,140

[45] Date of Patent: Dec. 15, 1998

[54] LABEL APPLICATOR

[76] Inventor: Marvin Earl Bilnoski, Jr., 201 Riverside Dr., Highlands, Tex. 77562

[21] Appl. No.: 899,763

[22] Filed: Jul. 24, 1997

[51] Int. Cl.[6] ..... B65H 39/00

[52] U.S. Cl. ..... 156/556; 270/58.31; 414/789.5

[58] Field of Search ..... 270/58.31; 156/483, 156/484, 485, 293, 423, 556; 414/789.5

[56] References Cited

U.S. PATENT DOCUMENTS 3,205,739 9/1965 Meyer-Jagenberg ..... 270/58.31 X 4,749,179 6/1988 Hornung ..... 270/95

*Primary Examiner*—James Engel

*Attorney, Agent, or Firm*—Richard C. Stewart, II

[57] ABSTRACT

This invention relates to a labeling apparatus and system for imprinting, dispensing and inserting labels in between layers of paper or other material arranged in bales which are movable along a conveyor line. The apparatus utilizes a label inserting mechanism and a label transfer mechanism to fold and to insert non-adhesive labels in between layers of the bale without damaging the stock.

13 Claims, 1 Drawing Sheet

LABEL APPLICATOR

FIELD OF INVENTION

This invention relates to a system and apparatus for imprinting, dispensing, and inserting labels in between layers of paper or other material contained in a bale thereof movable along a conveyor line.

BACKGROUND OF THE INVENTION

This invention is generally directed to a system for inserting labels in between layers of paper or other material packaged in bales, in particular, to such bales which are movable along a conveyor line.

Modern business practices dictate that many articles have labels affixed thereto: articles on display for sale, articles stored in warehouses, articles moving through various stages of processing, articles tracked by lot numbers and a host of other articles required by present day business for its day to day operation. The application of labels to articles and products has been and continues to be an important step in providing product identification, specific product information and marketing advantages. Manufacturers of various products are continually seeking a more efficient and effective manner in which to apply labels to articles or items, such as cartons, containers or any other packages or products having a surface capable of receiving a label.

Numerous methods have been employed in the past to mark articles, such as color-coded ink sprays and manually applied stickers. In addition, modern computer controlled label printers make it possible to print a highly individualized label for each of a series of product units. However, while modern computer controlled label printers make it possible to print a highly individualized label for each of a series of product units, to print the labels on one machine and then apply the same with another machine requires an expenditure for two machines with possible duplication of elements (such as motors, etc.) as well as a waste of valuable time in re-reeling the printed labels and transferring same to the applying machine.

Many labels used today have applied thereto a water responsive adhesive and others utilize a heat responsive adhesive. In addition, a large number of the labels used today are of the pressure sensitive adhesive type and are disposed one after the other along a strip of release backing paper, formulated to permit the labels to be readily separated therefrom, with the strip and attached labels usually distributed in roll form. Many of these adhesive labels are release-type labels which can be taken on and off of the article being labeled. The typical labeling operation entails printing certain information on a predetermined number of labels and then applying the labels so printed to a like number of articles. The introduction of adhesive-backed pressure sensitive labels and hand-held, manually operated applicators has greatly facilitated the marking of articles in that the applicators provide a simple means for applying an adhesive-backed label to an article. Such hand-held label applicators are well known and used extensively in various industries, for example, for marking the price of articles to be sold. Their use, however, in manufacturing, assembling and distributing applications is limited because of the necessity for marking many items at a high rate of speed. In these applications, the articles to be labeled are transported along a conveyor past a number of stations, one of which often entails the application of a label to each article as it passes by or while the conveyor is momentarily stopped. Use of a hand held label applicator in this type of high speed operation would be unacceptably slow, inefficient, labor intensive and therefore, impractical due to the time constraints associated with high volume production. These labelers, in addition to requiring a means for applying the label, require a means for removing the adhesive backing prior to applying the label, thus making such labelers more complex.

In addition, in a typical conventional label applicator, a label having one face coated with a pressure sensitive adhesive is removed from a backing strip or web and supplied to a grid. The label is often retained against the grid by vacuum pressure applied to the inner face of the grid. When an article to be labeled reaches an appropriate position at the labeling station, a blast of gas, such as air, transfers the label from the grid to the article, and the pressure sensitive adhesive adheres the label to the article. This typical conventional label applicator is dependable and most satisfactory for many labeling operations. However, when attempting to apply labels for insertion in between layers of paper or other material packaged in bales, a vacuum/blowing system would not be sufficient as it is only capable of applying adhesive labels to the surface of an article. In addition, adhesive labels, whether of the heat, water, pressure or release type, are not well suited for applying to bales of paper due to the irregular surface of the bales.

In other labelers, the cyclic operation of the machine is accomplished by the provision of an arm which rides upon the surface of the labels and drops into a space which must be provided between successive labels to control said cyclic operation. The arm, however, quite often damages the edges or other portions of the labels as it moves thereover, and in some instances, smears or otherwise distorts the printed matter which has been disposed thereon. In other labelers, photo-responsive cells are used to sense the space between the labels which are disposed or carried on webs. The circuitry which must be provided to sense the difference between the opacity of the web and label, and the opacity of the web alone, however, is expensive, complex, and highly susceptible to differences in the label and web stock as well as dirt, color and other conditions. In both circumstances, the labels must be disposed along the web so as to provide the required space therebetween, thus limiting the number of labels that can be placed on a web of a given size.

Accordingly, there is a need to provide an improved labeling system or apparatus which allows labels to be inserted between layers of paper or other material packaged in bales as such bales move along a conveyor line. More specifically, there is a need to label the bales with non-adhesive labels utilizing an apparatus comprising as few components as possible, but which will still securely insert the label between layers of the bale.

SUMMARY OF THE INVENTION

It is the primary objective of this invention to provide an improved labeling system or apparatus for inserting labels in between layers of paper or other material packaged in bales which are movable along a conveyor line. More specifically, it is an object of this invention to provide a labeling apparatus for bales of paper utilizing an apparatus comprising as few components as possible, but still securely inserting one label between layers of the bale and depending a second label from said first label, thus leaving the bale in a condition for transport and storage, and without damaging the stock prior to use by a consumer.

A further object of this invention is to provide an improved labeling apparatus which is time efficient and prints, dispenses and applies the labels without requiring duplicate elements and which does not damage, smear or otherwise distort the printed matter on the label.

Still a further object of this invention is to provide an improved labeling design which facilitates easy application of the label between the layers of the bale of paper or other material movable along a conveyor line without using heat, water or pressure adhesive labels and without damaging the paper or other material of the bale.

The above mentioned objectives are attained by this invention which is directed to a labeling system or apparatus for inserting a label between layers of a bale of paper or other material while moving along a conveyor line. The labeler includes: (1) a label inserting means which comprises, in part, a head which extends linearly from a label loading position to a label inserting position; and (2) a label transfer means which comprises, in part, a wedge which extends linearly from a retracted position through an aperture in the head to an extended position, whereby the wedge folds and inserts a first label between layers of a bale of paper or other material and a second label, attached to the first label, depends from said first label.

BRIEF DESCRIPTION OF THE DRAWINGS

The present invention will be understood and appreciated more fully from the following detailed description, taken in conjunction with the accompanying drawings in which.

DETAILED DESCRIPTION OF THE PREFERRED EMBODIMENTS

Figure 1:
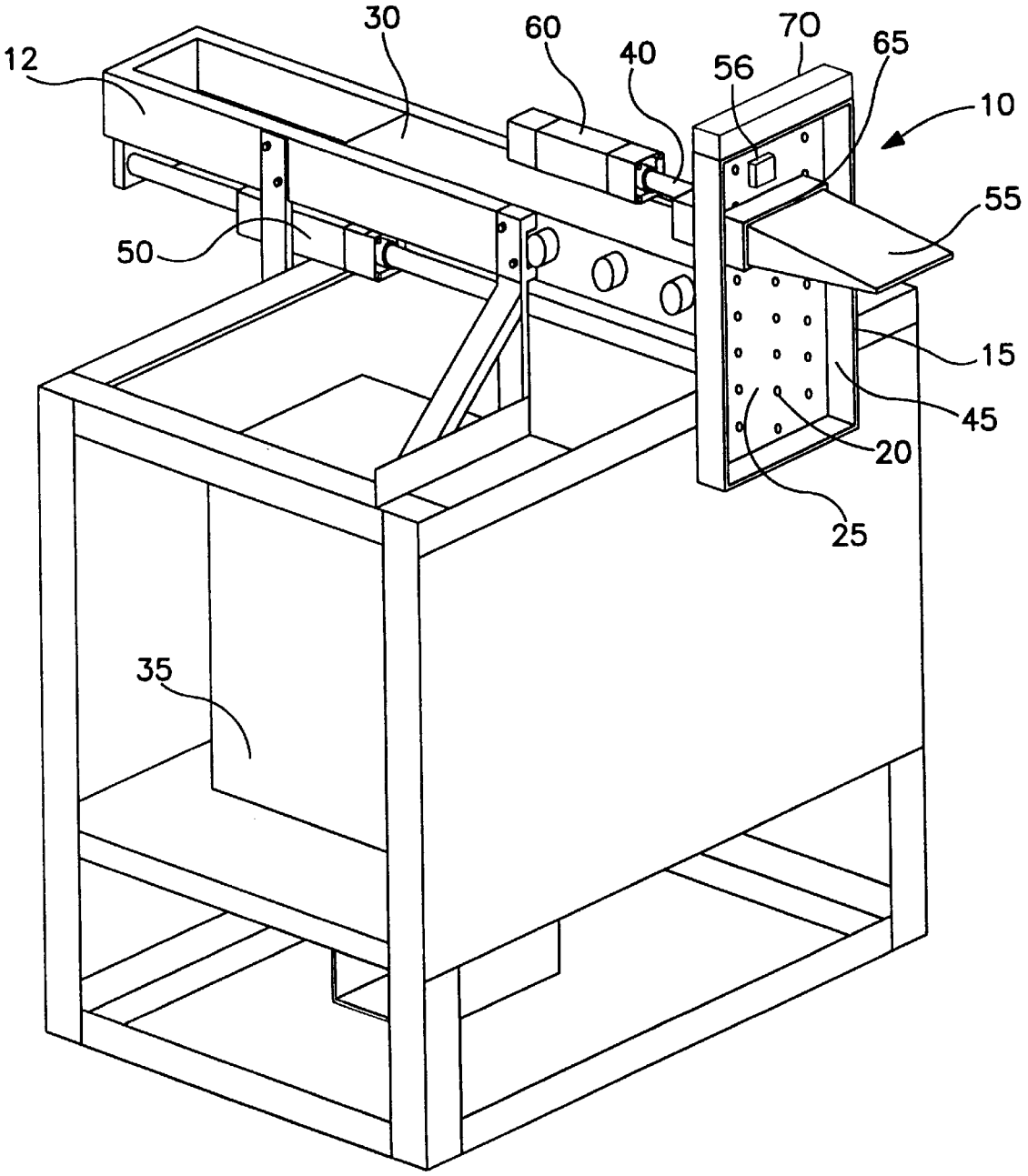
FIG. 1 is a perspective view of the labeling apparatus in a manner embodying the present invention.

By way of example, the present invention is illustrated in an apparatus for use in labeling bales of paper. The construction of this apparatus constitutes a preferred embodiment, and as illustrated herein, may be used in a number of different applications which would be obvious to those skilled in the art.

Shown in FIG. 1 is a general diagram of a labeling apparatus 10 embodying the present invention which allows a label to be inserted between layers of a bale of paper or other material while such bale is moving along a conveyor line. The present invention utilizes a label inserting mechanism 12 which includes a label receiver or a head 15 which includes a mechanism to releasably retain a label on the surface of the head. The head 15 is mounted on a supporting structure 30 for movement between a label loading position and a label inserting position. A printer 35 supplies a label to the surface 25 of the head 15 when the head is in the loading position. The label receiver or head 15 translates the label between the label loading and label inserting positions. After the head 15 is in the label inserting position, a label transfer means, which is also mounted for movement on the supporting structure 12, removes the label from the surface of the head 15, moves the label from a retracted position (i.e., retained on the surface of the head) to an extended position where the label is folded and inserted between layers of the bale of paper.

A bale of paper to be labeled will be movable along a conveyor line, such that the bale will be positioned in front of the labeling apparatus 10. A sensor senses when the front end of a bale is in a label inserting station. The sensor can comprise any sensing means well known in the art, for example, a mechanical switch. In a preferred embodiment, the sensor comprises an optical sensor such as a photocell.

In the preferred embodiment of the present invention, and referring to FIG. 1, labels are printed by the printer 35 which is mounted beneath the support structure 30. The printer 35 may be any printer known in the art capable of printing the printed matter on a first side of each label. The printer 35 will print two labels and cut the media after the second label. As the labels are printed, they are fed into a passageway or grooves 45 formed in the head 15 which is preferably made from Teflon™.

In the preferred embodiment, two printed labels are received from the printer through the grooves 45 formed on the outer edges of the head 15 until the first label is on the surface 25 of the head 15. One method of retaining the label on the surface of said head is by applying reduced pressure. This reduced pressure may be supplied by a transvector 70 which creates a vacuum through holes 20 formed in the surface 25 of the head and retains the label tightly against the surface of the head 15. Other methods include mechanical latches or clips, or magnetic devices for labels having metallic content. The head 15, while in the label loading position, receives through the grooves 45 in the head 15 the printed labels from the printer 35. As the first label reaches the top of the head 15, it activates a sensor 56 mounted in the top of the head 15 which activates the means of reducing pressure on the surface of the head. When the sensor is triggered, it energizes a solenoid which activates the transvector 70 or the like coupled to a port in the head 15 by a pipe or the like as will now be apparent to those skilled in the art, thereby releasably retaining the label on the surface of the head.

Once the label is retained on the surface 25 of the head 15, the head is advanced from the label loading position to the label inserting position. As shown in FIG. 1, in the preferred embodiment, the means of advancing the labels retained on the surface of the head comprises a piston-cylinder arrangement 50, having an anchored end and a movable end, such that the movable end is attached to the support structure 30. The head 15 is attached to the support structure 30 at the end of the structure which is closest to the bale to be labeled. The piston-cylinder arrangement 50 moves the head 15 forwardly, via the support structure 30, toward the bale. When the sensor is triggered, in addition to energizing a solenoid which activates the transvector 70, the sensor also energizes a second solenoid which activates the above-mentioned piston-cylinder arrangement 50, thus, causing the head 15 and the labels to be moved from the loading position to the inserting position. In the preferred embodiment, the label receiver or head 15 moves along a straight, linear path. In addition, this piston-cylinder arrangement 50 is dimensioned such that the head 15, while extended to the label inserting position, is pushed against the bale. In the preferred embodiment, this piston and cylinder arrangement has about a 20 inch stroke.

Once the label inserting mechanism 12 is moved to the label inserting position with the label retained on the surface 25 of the head 15, the label transfer mechanism 40 inserts the label between layers of the bale of paper. The transfer mechanism 40 of the label transfer means may be of any specific type now apparent to those skilled in the art. In the preferred embodiment, the label transfer means includes automatic means from a first or retracted position, which is a label pick-up point, to a second or extended position which is a position where the label is inserted between layers of the bale. Thus, the specific construction and operation of such automatic transfer mechanism may vary widely as will now be apparent to those skilled in the art from relatively simple rotation and extension structures based on hydraulic or pneumatic cylinders to relatively complex robotic arms which allow movement to many different axes, etc.

In the preferred embodiment, the label transfer means incorporates a wedge 55 which is moved from a retracted position to an extended position (shown in FIG. 1). The wedge follows a straight, linear path provided by a second piston-cylinder arrangement 60, having an anchored end and a movable end, said second arrangement being mounted on the supporting structure 30. The wedge 55 is mounted on the movable end of the second piston-cylinder arrangement 60. When the head 15 and label which is retained on the surface of said head advance and reach the label inserting position where the head 15 and label are pushed against the bale, the transvector solenoid deenergizes, thus, relieving the reduced pressure which retains the label to the surface 25 of the head 15. Simultaneous with the transvector solenoid deenergizing, a third solenoid is energized and causes the wedge 55, via the second piston-cylinder arrangement 60, to move from the retracted position through a rectangular aperture 65 in the head 15 to the extended position. As the wedge 55 moves toward the bale to the extended position, it removes the first label from the surface of the head and folds and inserts it at a controlled height in between layers of the bale of paper, thereby leaving the second label depending from said first label which has been inserted in between layers of the bale.

Once the label has been inserted between layers of the bale, the label inserting mechanism 12 and the label transfer mechanism 40 return to their original positions—the label loading position and the retracted position, respectively. When both the label inserting mechanism 12 and the label transfer mechanism 40 are in their original position, the labeled bale is moved out of the label inserting station, and the conveyor begins to move other bales until a further bale is in the label inserting station. At that point, the presence of a bale at the label inserting station is sensed and the entire cycle is run once again. In the preferred embodiment, once the wedge 55 has reached the extended position and the label has been inserted, the second and third solenoids are deenergized, thus causing both piston-cylinder arrangements to retract—leaving the head 15 in its label loading position and the wedge 55 in its retracted position. Thus, the labeling apparatus 10 is ready to repeat the cycle.

The above embodiments are provided only for the purposes of explaining the applicant's invention and it will be appreciated by those skilled in the art that the applicant's invention is not limited to what has been particularly shown and described hereinabove. Further, it will be apparent to those skilled in the art that various modifications and variations could be made in the present labeling apparatus or system without departing from the scope or spirit of the invention. For example, it will be obvious to those skilled in the art that the dimensions of the labeler may be varied to apply labels to bales of paper or other material which vary in size. In addition, it will be obvious to those skilled in the art that any material transported or stored in layered bales, such as paperboard, woven and non-woven fabric, synthetic film, wood veneer and the like, may be substituted in place of bales of paper described herein.

What is claimed is:

1. A label inserting apparatus for inserting labels in between layers of paper or other material arranged in a bale comprising:

a first piston-cylinder arrangement having a stationary end and a movable end, said arrangement having a first travel path from a label loading position to a label inserting position;

a second piston-cylinder arrangement having a stationary end and a movable end, said second arrangement having a second travel path from a retracted position to an extended position;

a head having a surface for receiving the label, a rectangular aperture formed through said head;

a wedge attached to the second piston-cylinder arrangement at the movable end of said second piston-cylinder arrangement, said wedge having a length, a width and a decreasing height;

a sensor positioned on the head, said sensor activating when the label is on the surface of said head;

a mechanism to retain the label to the surface of the head;

a first solenoid connected to the first piston-cylinder arrangement, said first solenoid causing said first piston-cylinder arrangement to advance when the sensor is activated, thereby moving the head from said label loading position to said label inserting position; and a second solenoid connected to the second piston-cylinder arrangement, said second solenoid causing said second arrangement to advance when the head is advanced to the label inserting position, thereby advancing the wedge from said retracted position through the aperture in the head to said extended position and causing the wedge to remove the label from the surface of the head, fold said label and insert it in between layers of said bale.

2. The label inserting apparatus of claim 1, further comprising a support structure having a first and a second end, said head and said movable end of the first piston-cylinder arrangement being attached to the second end of said support structure.

3. The label inserting apparatus of claim 1, wherein said mechanism to retain the label to the surface of the head comprises a mechanism to apply reduced pressure to the surface of the head to releasably retain the label to the surface of the head.

4. The label inserting apparatus of claim 3, wherein said mechanism to apply reduced pressure utilizes a third solenoid, said solenoid causing said mechanism to apply reduced pressure to the surface of the head when said sensor is activated.

5. The label inserting apparatus of claim 4, wherein said first and said third solenoids are activated simultaneously.

6. The label inserting apparatus of claim 1, wherein said first travel path and said second travel path are linear.

7. The label inserting apparatus of claim 1, wherein said head is a rectangular shaped block.

8. The label inserting apparatus of claim 1, wherein said first piston-cylinder arrangement has a stroke of about 20 inches.

9. The label inserting apparatus of claim 1, wherein said second piston-cylinder arrangement has a stroke of about 3.5 inches.

10. The label inserting apparatus of claim 1, wherein said surface of said head comprises Teflon™.

11. A method of inserting labels in between layers of paper or other material arranged in a bale comprising:

providing an apparatus for inserting labels, said apparatus including a head to receive the label to be inserted;

supplying a label to the head when the head is in a first position;

retaining the label on the head;

moving the head from the first position to a label inserting position in which the head and the label retained on the head are positioned so as to abut against the bale in which the label is to be inserted;

providing a wedge which is recessed in an aperture formed in the head, said wedge being in a first retracted position; and moving the wedge from the retracted position through the aperture in the head to a second extended position, thereby pushing the label from the surface of the head.

12. The label inserting method of claim 11, wherein the label is releasably retained on the head.

13. The label inserting method of claim 11, wherein the label is folded and inserted between layers of the bale when the wedge removes said label from the surface of the head.

* * * * *